United States Patent [19]

Ito et al.

[11] Patent Number: 5,058,820

[45] Date of Patent: Oct. 22, 1991

[54] STRIP-LIKE MEMBER TAKE-UP DEVICE

[75] Inventors: Masahiko Ito, Yokohama; Shinji Murata, Tokyo, both of Japan

[73] Assignee: Canon Kabushiki Kaisha, Tokyo, Japan

[21] Appl. No.: 415,392

[22] Filed: Sep. 28, 1989

Related U.S. Application Data

[63] Continuation of Ser. No. 148,751, Jan. 26, 1988, abandoned.

[30] Foreign Application Priority Data

| | | | |
|---|---|---|---|
| Jan. 30, 1987 | [JP] | Japan | 62-018540 |
| Jan. 30, 1987 | [JP] | Japan | 62-018541 |
| Feb. 27, 1987 | [JP] | Japan | 62-42730 |
| Feb. 27, 1987 | [JP] | Japan | 62-42731 |

[51] Int. Cl.[5] ..... B65H 18/14; B65H 18/26

[52] U.S. Cl. ..... 242/67.1 R; 242/195; 353/26 R

[58] Field of Search ..... 242/67.1 R, 67.3 R, 242/67.4, 67.5, 78.3, 195; 353/26 R, 26 A

[56] References Cited

U.S. PATENT DOCUMENTS

| | | | |
|---|---|---|---|
| 3,535,029 | 10/1970 | Portman et al. | 353/26 R |
| 3,652,157 | 3/1972 | Blackert et al. | 353/26 R X |
| 4,069,989 | 1/1978 | Pfeifer et al. | 242/195 |

FOREIGN PATENT DOCUMENTS

| | | |
|---|---|---|
| 3491 | 3/1942 | Japan . |
| 63645 | 4/1983 | Japan . |
| 63646 | 4/1983 | Japan . |
| 153744 | 9/1984 | Japan . |

*Primary Examiner*—Stanley N. Gilreath

*Attorney, Agent, or Firm*—Fitzpatrick, Cella, Harper & Scinto

[57] ABSTRACT

A strip-like member take-up device has take-up means for taking up a strip-like member being fed thereto, drive means for rotatively driving the take-up means, and an endless belt member for urging the strip-like member taken up by the take-up means against the take-up means and being moved in accordance with the rotation of the take-up means.

26 Claims, 13 Drawing Sheets

STRIP-LIKE MEMBER TAKE-UP DEVICE

This application is a continuation of application Ser. No. 148,751 filed Jan. 26, 1988, now abandoned.

BACKGROUND OF THE INVENTION

1. Field of the Invention

This invention relates to a device for taking up a strip-like member such as a film onto a take-up shaft such as a reel.

The device of this type is used, for example, to take up microfilm wound on a reel onto another reel (a take-up device) to thereby move the frames of the film between the two reels and select a desired frame.

2. Related Background Art

The techniques described, for example, in Japanese Utility Model Publication No. 3491/1967, Japanese Laid-Open Patent Application No. 63645/1983, Japanese Laid-Open Patent Application No. 63646/1983 and Japanese Laid-Open Patent Application No. 153744/1984 are known as conventional strip-like member take-up devices. These are of a construction in which guide rollers having rotary shafts parallel to a take-up shaft are disposed around the take-up shaft and cause the take-up shaft to take up the leading end of a strip-like member such as a film. A typical example thereof will hereinafter be described with reference to FIGS. 18 and 19 of the accompanying drawings. In these figures, the reference numeral 1 designates a take-up shaft having attached thereto flange plates 1A and 1A substantially parallel to the width of a film. The flange plates are provided with pawls 1B and 1B inwardly protruding to resiliently hold the edges of the film therebetween. Guide rollers 10 and 11 mounted on arms 8 and 9, respectively, pivotable about shafts 8A and 9A, respectively, are in contact with the take-up shaft 1 to hold the film F between them and the take-up shaft 1, and the pawls 1B and 1B resiliently hold the edges of the film F being taken up and cause the film F to be wound onto the take-up shaft. As the amount of take-up increases, the arms 8 and 9 may pivotally move to thereby move the guide rollers 10 and 11. This device is constructed compactly, but since guiding is done only at the points of contact between the guide rollers and the take-up shaft, there has been the undesirable possibility of the film flying out in the direction of arrow C in FIG. 18.

Another example of the prior art is shown in FIG. 20 of the accompanying drawings In the figure, the reference numeral 1 denotes a take-up shaft having attached thereto flange plates 1A and 1A substantially parallel to the width of a film. The flange plates are provided with pawls 1B and 1B inwardly protruding to resiliently hold the edges of the film therebetween. Accordingly, the film F fed between the flange plates by a guide plate 2 is held by and between the pawls 1B and 1B and is wound onto the take-up shaft 1 by means of a belt 7 passed over immovable pulleys 3, 4, 5, a movable pulley 6 and the take-up shaft 1. As the amount of take-up progresses, the movable pulley 6 moves to a position as indicated by dots-and-dash lines in FIG. 20. In such a device, there is no possibility that in the portion wherein the film F is held between the take-up shaft 1 and the belt 7, the leading end of the film separates from the take-up shaft 1 and flies out. However, the film introducing portion of the take-up shaft 1 is not in contact with the belt 7 and therefore, in this portion, the leading end of the film F may separate from the take-up shaft 1 and fly out. To prevent the film from flying out and ensure the film to twine around the take-up shaft, the pawls 1B and 1B become necessary, and since the spacing between the pawls 1B and 1B is invariable, the width of the film which permits take-up is limited. Even if said spacing is made variable, the film cannot be accurately held between the pawls unless said spacing is set within a very narrow dimension, and the mechanism therefor will become complicated.

Also in FIG. 20, as the amount of take-up progresses, the movable pulley 6 moves to the position as indicated by dots-and-dash lines. In such a device, the movable pulley moves rectilinearly and therefore, the device requires a large space.

Also in FIG. 20, one of the immovable pulleys 3, 4 and 5 has been connected to a drive source so as to be rotatively driven and the take-up shaft 1 is rotatively driven by the belt 7.

When the film F is to be taken up in such an example of the prior art, if slack occurs in the leading end F1 of the film as shown in FIG. 21 of the accompanying drawings when the take-up of the film F is about to enter the second round at the start of the take-up of the film F, the slack tends to increase gradually. Such slack leads to an undesirable result during take-up and therefore, a countermeasure has been taken to eliminate it. For example, there is a method in which film keep pawls are finely arranged on the take-up reel, but in this method, the relative speeds of the flange portion provided with the keep pawls and the film must be balanced delicately. There is also a method of detecting the film speed by an encoder connected to a pulley through a belt to thereby control the film speed, but according to this method, the slack during the take-up of the film is liable to occur in the belt drive and therefore, due to the slip between the belt and the film, it has been difficult to control the film speed accurately.

SUMMARY OF THE INVENTION

It is an object of the present invention to solve the above-noted problems peculiar to the prior art and to provide a strip-like member take-up device which ensures a strip-like member to be reliably taken up.

It is a further object of the present invention to provide a strip-like member take-up device which is capable of taking up a strip-like member without reducing its take-up performance and irrespective of the width of the strip-like member.

It is still a further object of the present invention to provide a take-up device which does not permit slack from occurring in the leading end portion of a taken-up strip-like member.

It is yet still a further object of the present invention to make the device compact without reducing its take-up performance.

To achieve the above object, a device for taking up a strip-like member onto a take-up shaft in accordance with the present invention has an immovable pulley disposed at an immovable position, a movable pulley which has a shaft parallel to the take-up shaft and whose position is movable, and a belt passed over said immovable pulley, said movable pulley and said take-up shaft, said movable pulley being biased in a direction to increase the twining angle of the belt on the take up shaft.

DESCRIPTION OF THE PREFERRED EMBODIMENTS

A microfilm reader will first be described as an example of an apparatus to which the present invention is applied.

Figure 1:
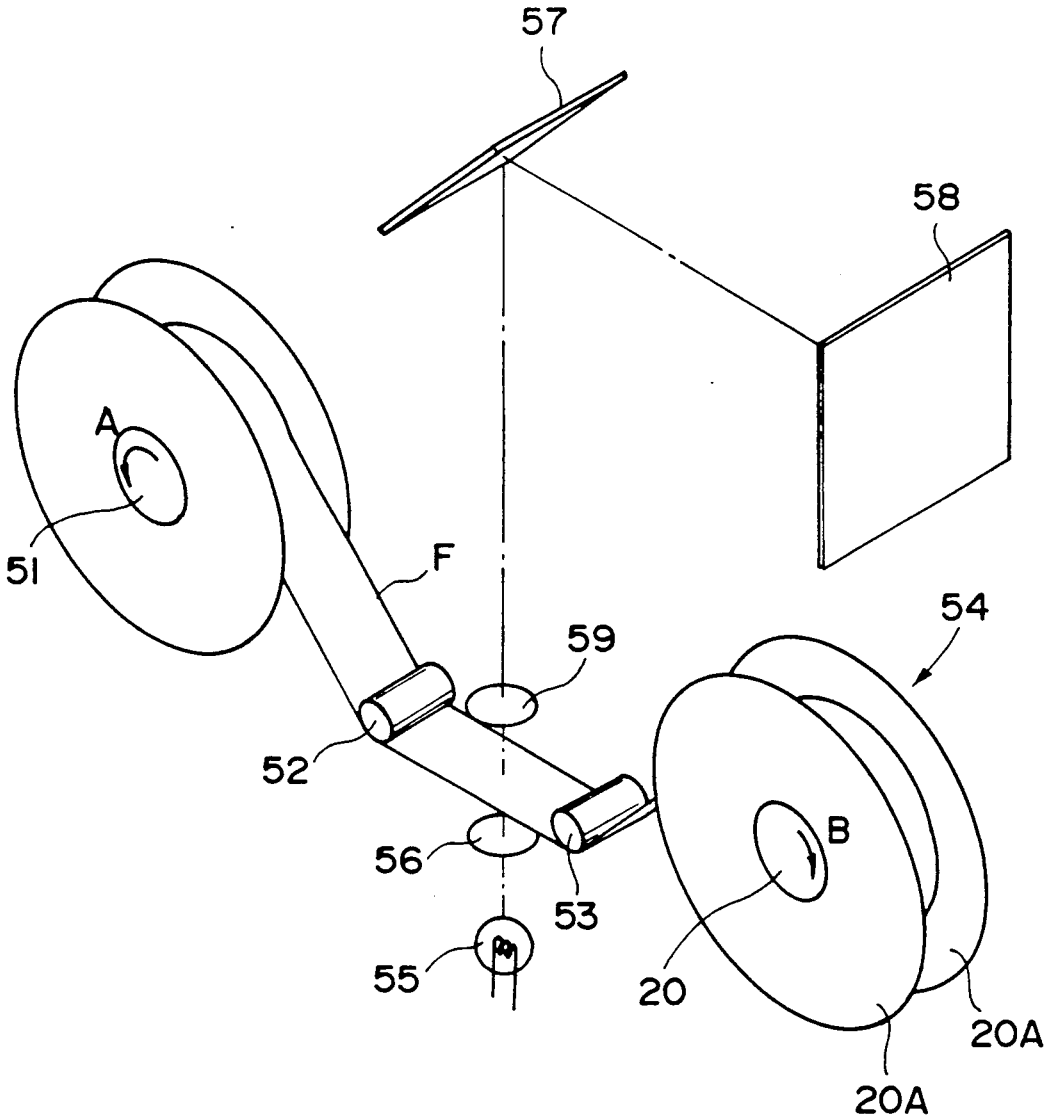
FIG. 1 is a schematic view of a microfilm reader to which the present invention is applicable.

FIG. 1 schematically shows a microfilm reader. The reference numeral 51 designates a reel on which a film is wound, the reference numerals 52 and 53 denote pulleys for guiding the film, and the reference numeral 54 designates a film take-up device provided with a take-up shaft 20 and flanges 20A, 20A. The reference numeral 55 denotes a lamp for irradiating the film, the reference numeral 56 designates a field lens, the reference numeral 57 denotes a mirror, the reference numeral 58 designates a screen, and the reference numeral 59 denotes a projection lens. The leading end of the film F taken out from the reel 51 is guided by the pulleys 52 and 53 and taken up by the take-up shaft 20. Then, by the reel 51 being rotatively driven in the direction of arrow A by a motor, not shown, or by the take-up device 54 being rotatively driven in the direction of arrow B by a motor, not shown, the film is moved to the left or the right and a desired frame of the film is carried onto the optical path. The frame on the optical path is irradiated by the lamp 55 through the field lens 56 and is projected onto the screen 58 by the projection lens 59.

Figure 2:
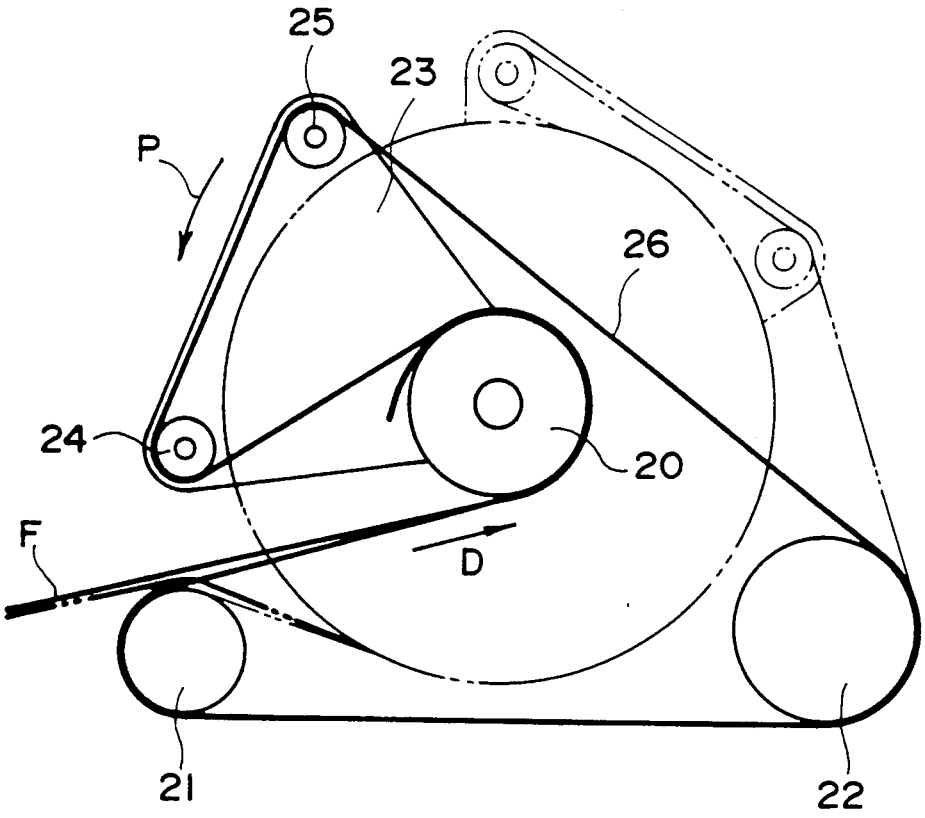
FIG. 2 is an elevational view illustrating an embodiment of the present invention.
Figure 3:
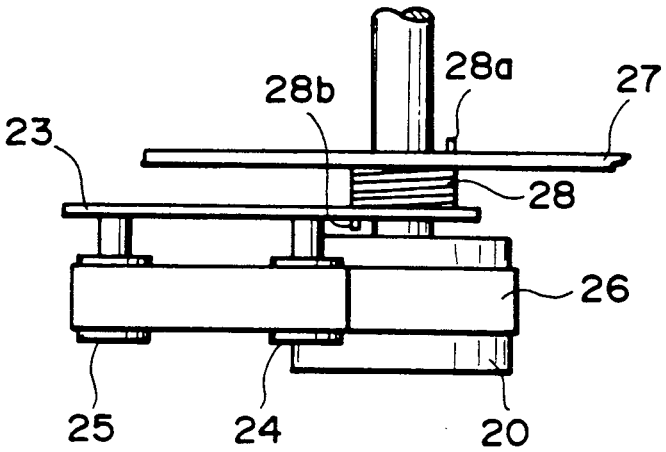
FIG. 3 is a plan view of the FIG. 2 embodiment.

The strip-like take-up device of the present invention applied to the film take-up device of FIG. 1 will now be described with reference to FIG. 2, and FIG. 3 which is a plan view thereof.

Figure 18:
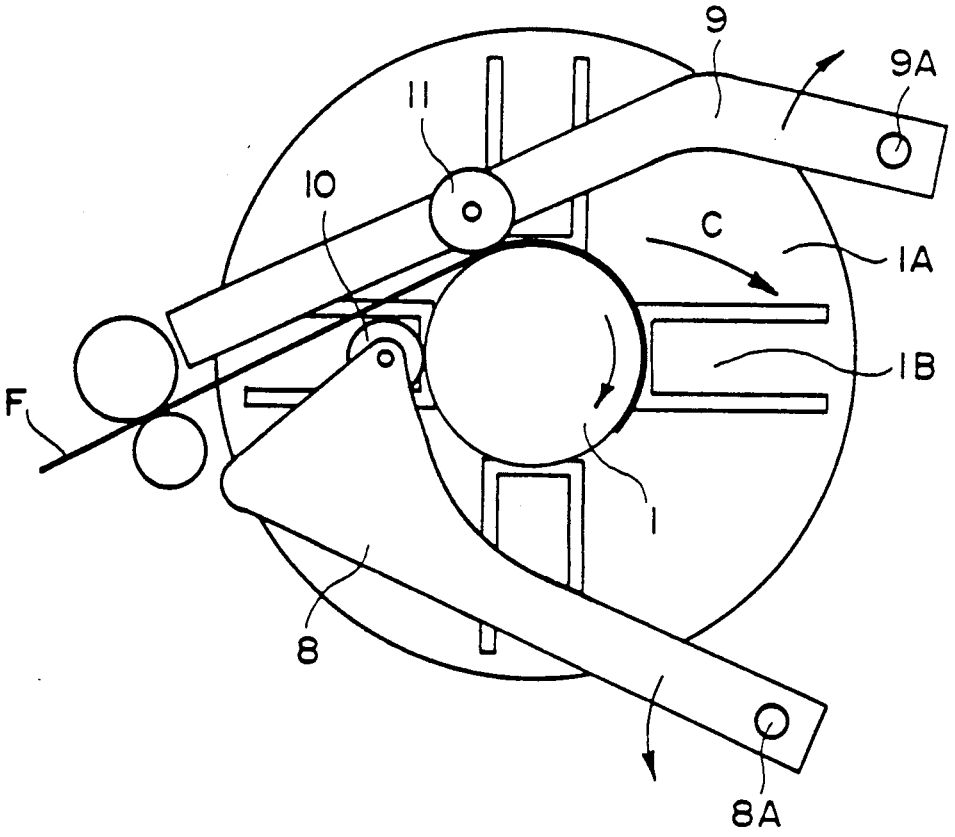
FIG. 18 PRIOR ART
FIGS. 18, and 20 are elevational views showing the strip-like member take-up devices
Figure 19:
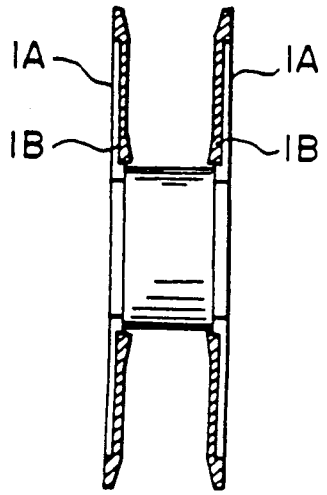
FIG. 19 PRIOR ART
FIG. 19 shows a sectional view according to the prior art.
Figure 20:
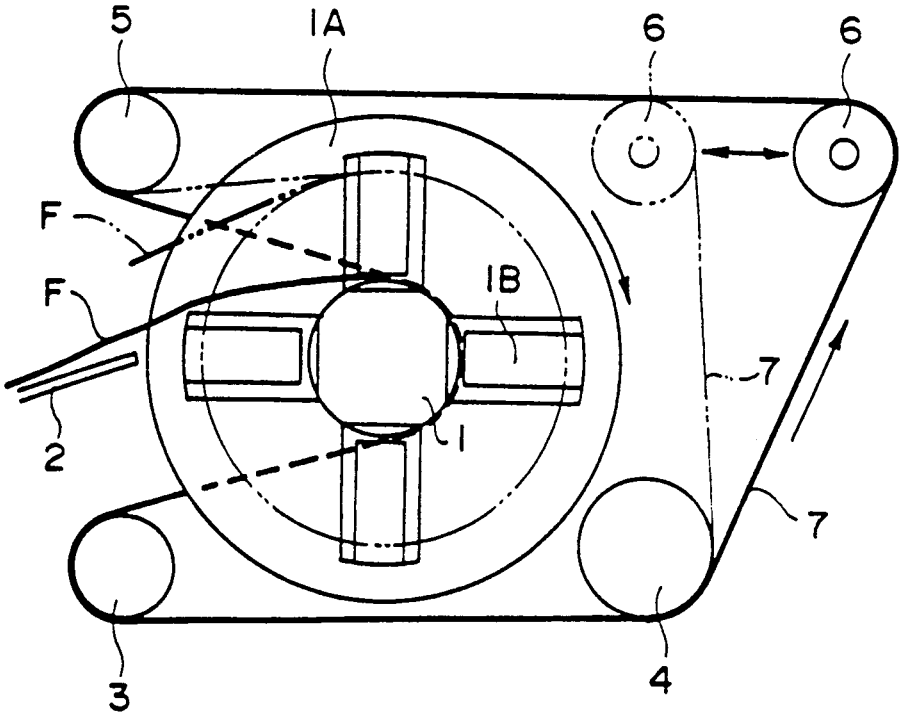
FIG. 20 PRIOR ART
Figure 21:
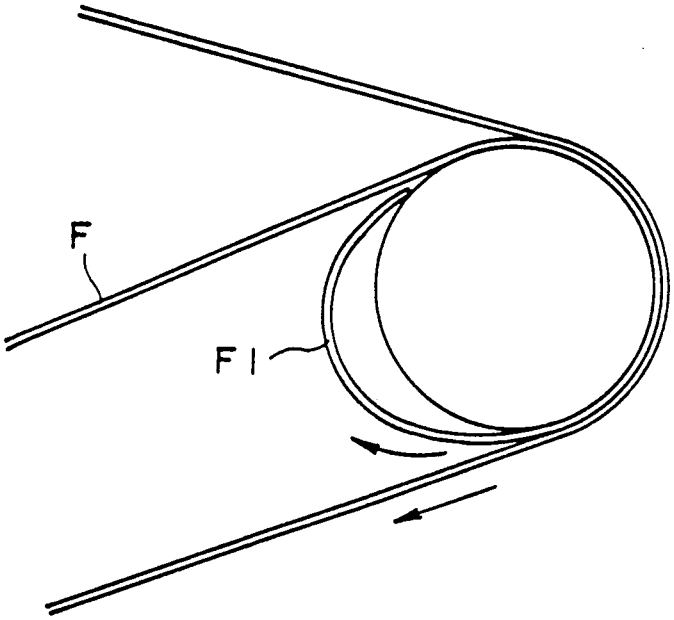
FIG. 21 PRIOR ART
FIG. 21 is an elevational view illustrating the operation of the device of FIG. 20.

In these figures, the reference numeral 20 designates a take-up shaft which, although not shown, is provided with flanges having pawls for holding the edge of a film therebetween, like the conventional one shown in FIGS. 18 and 20.

Immovable pulleys 21 and 22 whose central positions are immovable are rotatably disposed on the opposite sides below the take-up shaft 20.

A pivotable arm 23 in the form of a triangular plate is pivotably provided on the take-up shaft 20, and movable pulleys 24 and 25 are rotatably mounted on the two corners of the pivotable arm 23.

A belt 26 is passed over the take-up shaft 20, the immovable pulleys 21, 22 and the movable pulleys 24, 25, as shown.

Further, the pivotable arm 23 is biased in the direction of arrow P by a spring 28 having one end **28*a* engaged with a body frame 27 and the other end 28*b* engaged with the pivotable arm 23, and the portion of the belt 26 which leads from the movable pulley 24 to the take-up shaft 20 is urged toward the take-up shaft 20** side.

In the device of the present embodiment having such a construction, the film F is guided from the immovable pulley 21 side by the belt 26 and is taken up while being nipped between the belt and the take-up shaft 20. At that time, the film F is brought into intimate contact with the take-up shaft 20 by the belt 26 over a sufficient distance and is taken up with the opposite side edges thereof held by the pawls provided on the flanges of the take-up shaft 20 and therefore, the leading end of the film does not fly out. Thus, the take-up progresses.

As the take-up of the film progresses and the take-up diameter thereof becomes greater, the pivotable arm pivotally moves to the right against the force of the spring as indicated by dots-and-dash lines, and the belt follows the film of said great diameter.

Thus, even if the diameter of the taken-up film becomes great, it can be coped with by the pivotal movement of the pivotable arm and therefore, the device does not require a large space.

Figure 4:
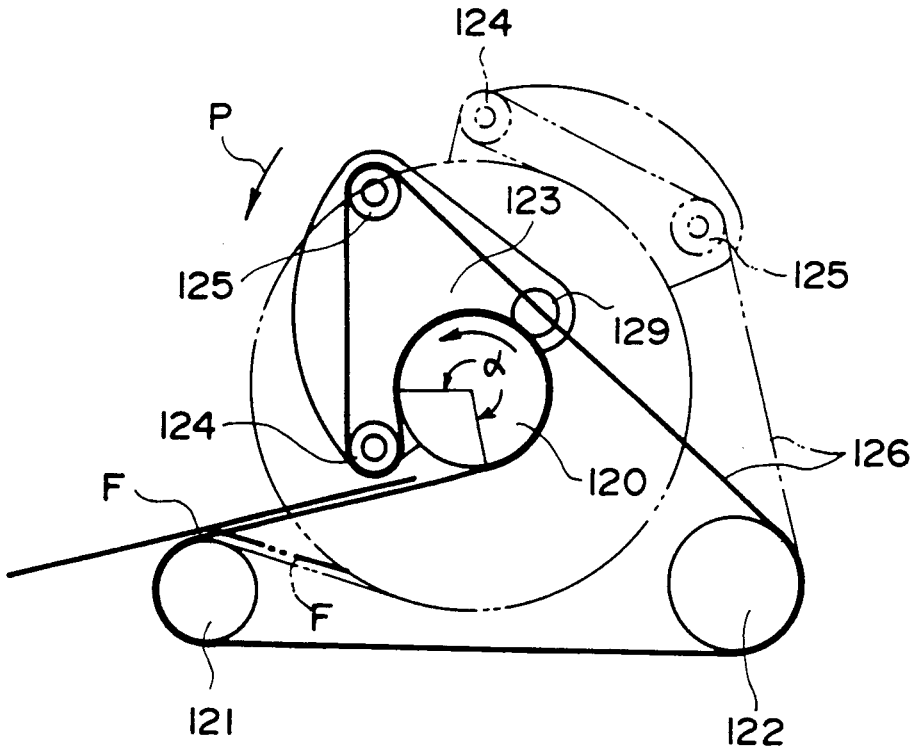
FIG. 4 is an elevational view illustrating a second embodiment of the present invention.
Figure 5:
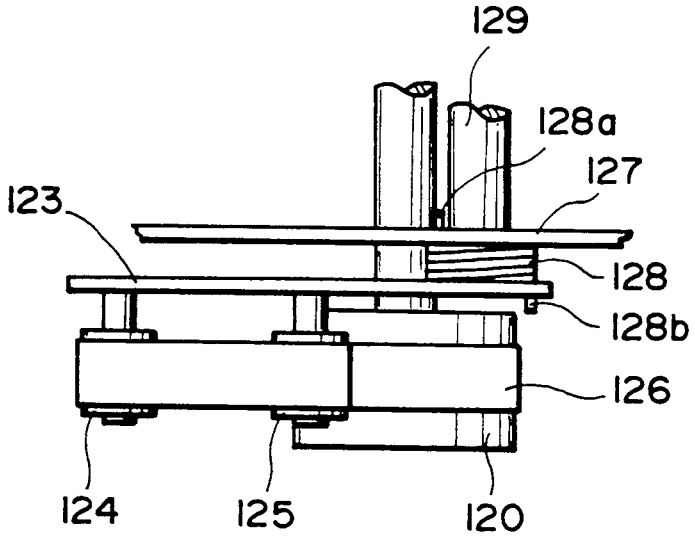
FIG. 5 is a plan view of the second embodiment.
Figure 6:
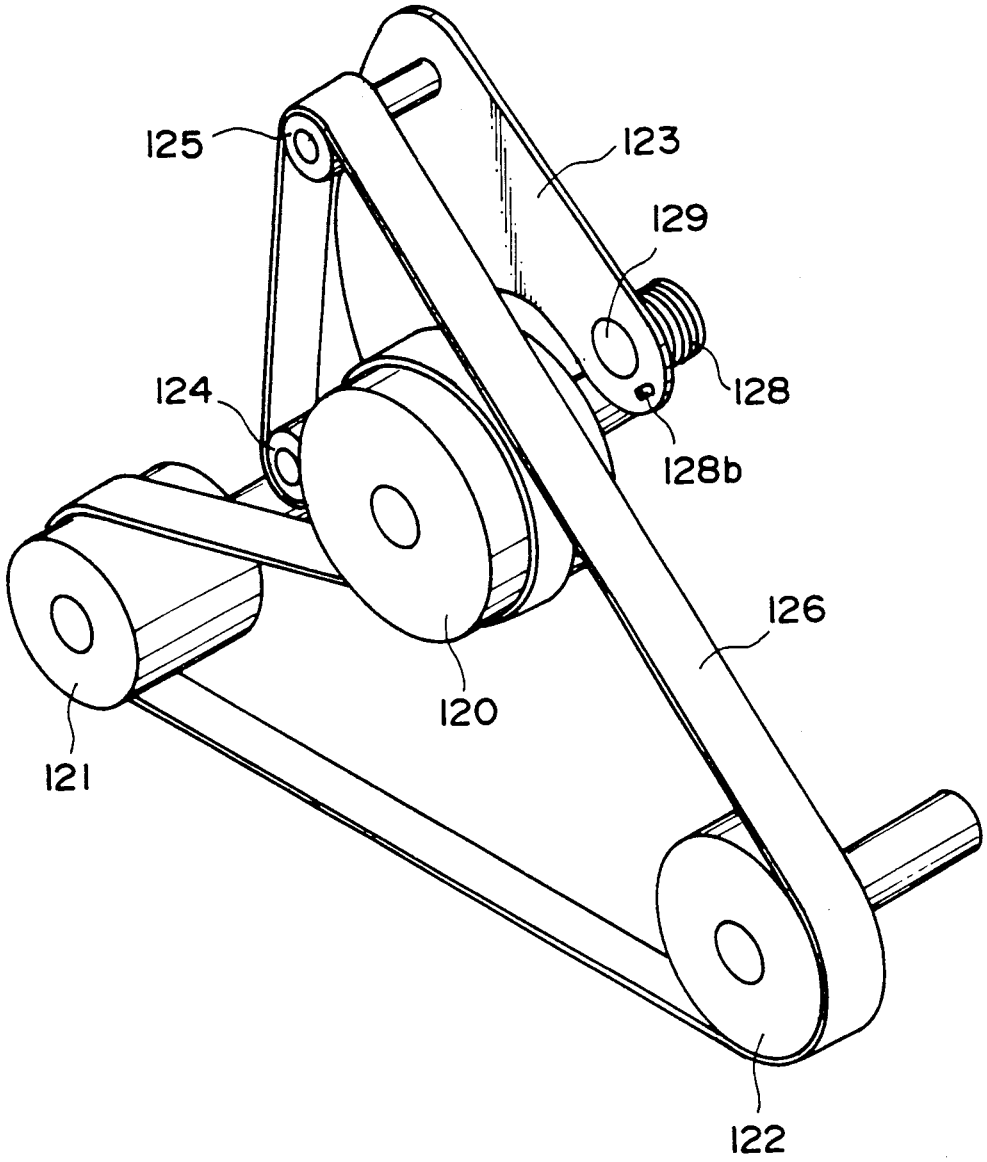
FIG. 6 is a perspective view of the second embodiment.

A second embodiment of the present invention will now be described. FIG. 4 is an elevational view of the second embodiment, FIG. 5 is a plan view thereof, and FIG. 6 is a perspective view thereof.

In these figures, the reference numeral 120 designates a take-up shaft which need not be provided with flanges having pawls for holding the film edges as in the first embodiment.

Immovable pulleys 121 and 122 whose central positions are immovable are rotatably disposed on the opposite sides below the take-up shaft 120.

A pivotable arm 123 in the form of a substantially triangular plate is pivotably provided on a pivot shaft 129 provided near the take-up shaft 120, and movable pulleys 124 and 125 are rotatably mounted on the two corners of the pivotable arm 123.

A belt 126 is passed over the take-up shaft 120, the immovable pulleys 121, 122 and the movable pulleys 124, 125.

A coil spring 128 is loosely fitted around the pivot shaft 129, and one end **128*a* of the coil spring 128 is engaged with a hole, not shown, in a body frame 127, and the other end 128*b* of the coil spring is engaged with a hole, not shown, in the pivotable arm 123**.

The pivotable arm 123 is biased in the direction of arrow P, i.e., the direction in which the twining angle $\alpha$ of the belt 126 on the take-up shaft 120 increases, by the coil spring 128.

In the device of the present embodiment having such a construction, the film F is guided from the immovable pulley 121 side by the belt 126 and is taken up while being nipped between the belt and the take-up shaft 120. In that case, said twining angle $\alpha$ is sufficiently secured when the take-up is started and therefore, even if the take-up shaft is not provided with flanges and the flanges are not provided with pawls, the film may be taken up by the take-up shaft 120 without the leading end thereof flying out.

As the take-up of the film progresses and the take-up diameter thereof becomes greater, the privotable arm 123 pivotally moves to the right against the force of the spring 128 as indicated by dots-and-dash lines in FIG. 4, and the belt follows the film of said great diameter.

Figure 7:
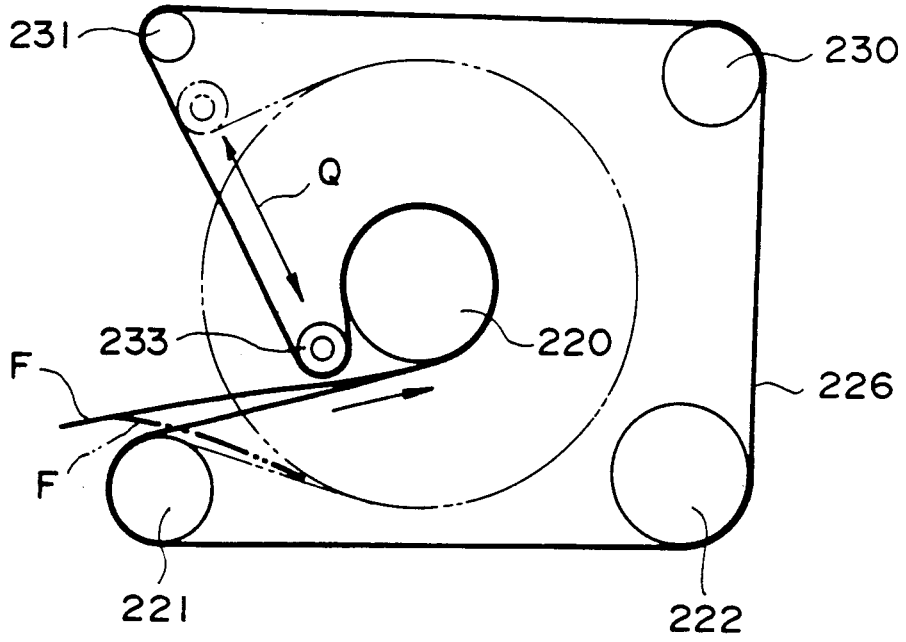
FIG. 7 is an elevational view illustrating a third embodiment of the present invention.
Figure 8:
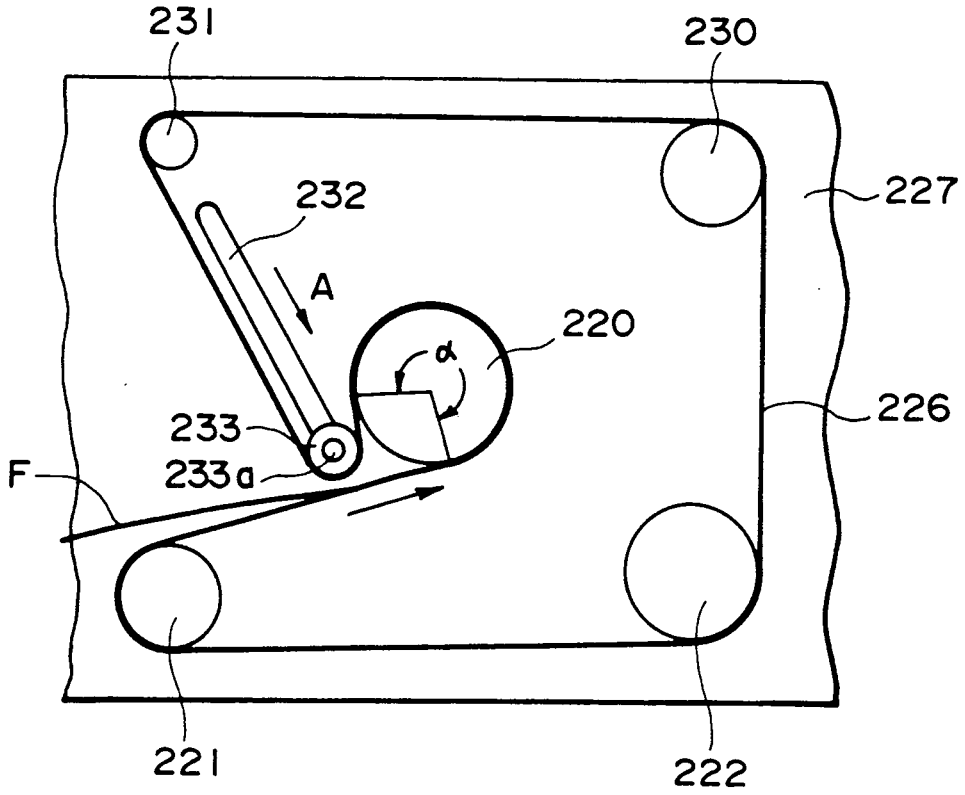
FIGS. 8 and 9 are elevational views illustrating the operation of the third embodiment.

A third embodiment of the present invention will now be described with reference to FIGS. 7, 8 and 9.

The reference numeral 220 designates a take-up shaft. Immovable pulleys 221, 222, 230 and 231 whose central positions are immovable are rotatably disposed around the take-up shaft 220. There is provided a movable pulley 233 movable in the direction of arrow Q in FIG. 7. A guide slit 232 is provided in a body frame 227 shown in FIG. 8, and the movable pulley 233 is movably provided with its rotary shaft 233*a* being guided by the guide slit 232.

A belt 226 is passed over the take-up shaft 220, the immovable pulleys 221, 222, 230, 231 and the movable pulley 233 as shown.

The rotary shaft 233*a* of the movable pulley 233 normally biased in the direction of arrow A, i.e., the direction in which the twining angle $\alpha$ of the belt onto the take-up shaft 220 increases, by spring means, not shown. Again in the present embodiment, the twining angle $\alpha$ is sufficiently secured and therefore, the film is taken up by the take-up shaft 220 without its leading end flying out.

Figure 9:
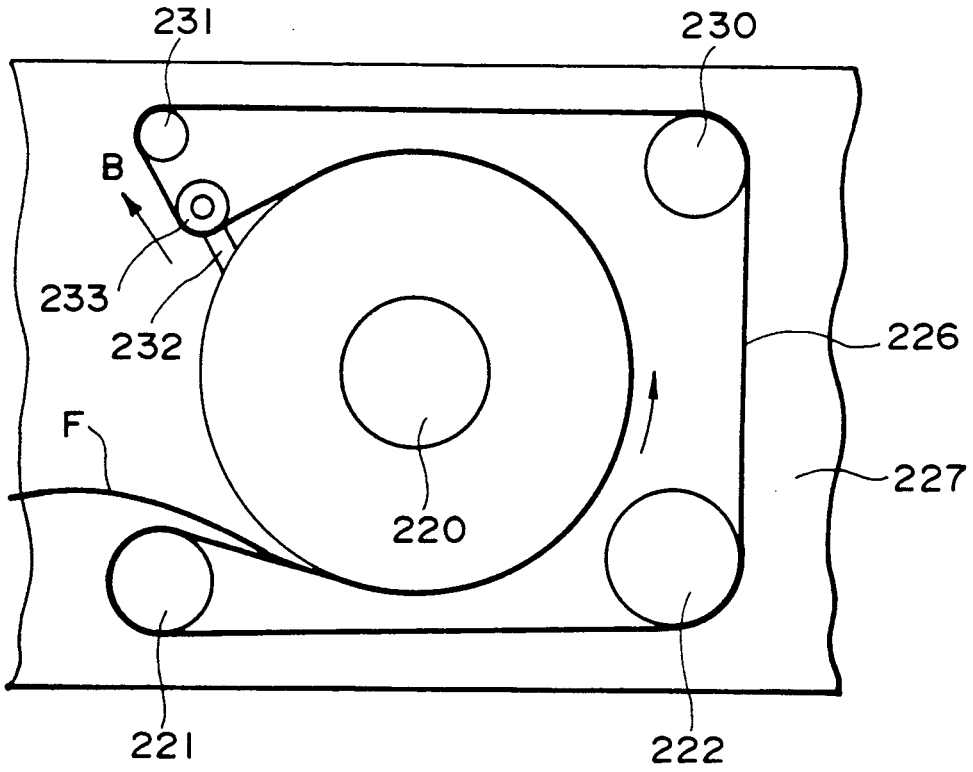

As the take-up of the film progresses and the take-up diameter becomes greater, the movable pulley 233 is guided by the guide slit 232 and moved in the direction of arrow B against the force of the spring means, as shown in FIG. 9, and the belt follows the increase in the take-up diameter.

Figure 10:
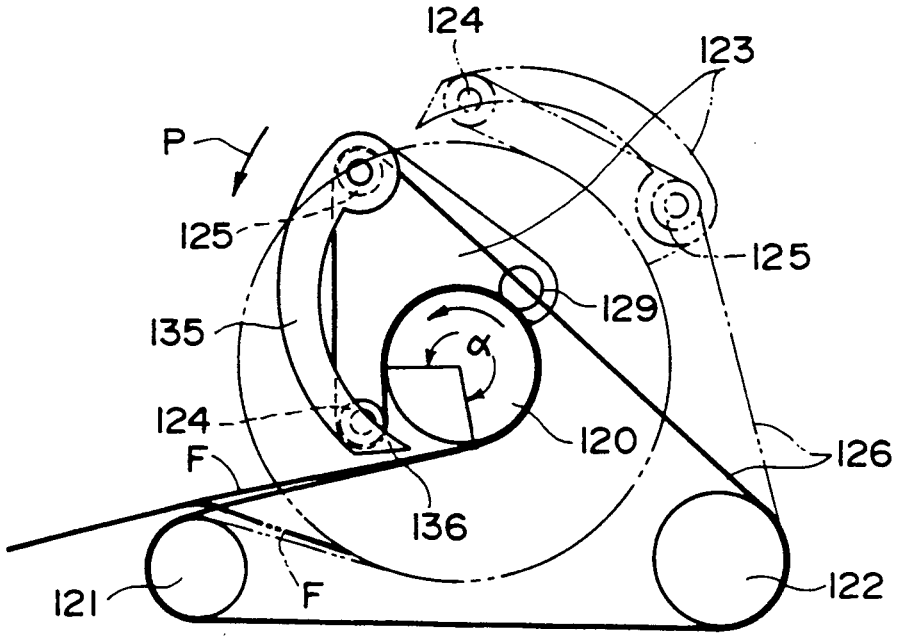
FIG. 10 is an elevational view illustrating the third embodiment.

A fourth embodiment of the present invention will now be described with reference to FIG. 10.

In the present embodiment, the pivotable arm 123 in the second embodiment described with reference to FIGS. 4 to 6 is provided with a pawl member 135 pivotable with the pivotable arm 23. The tip end 136 of the pawl member 135 is directed toward the take-up port for the film F.

In the present embodiment, said twining angle $\alpha$ is sufficiently secured when the take-up is started, and the film is wound by about one round and, when the second round is entered, the leading end of the film is inwardly guided by the tip end 136 of the pawl member 135 and therefore, the film is taken up by the take-up shaft 120 without its leading end flying out, and thus enters the second round.

Figure 11:
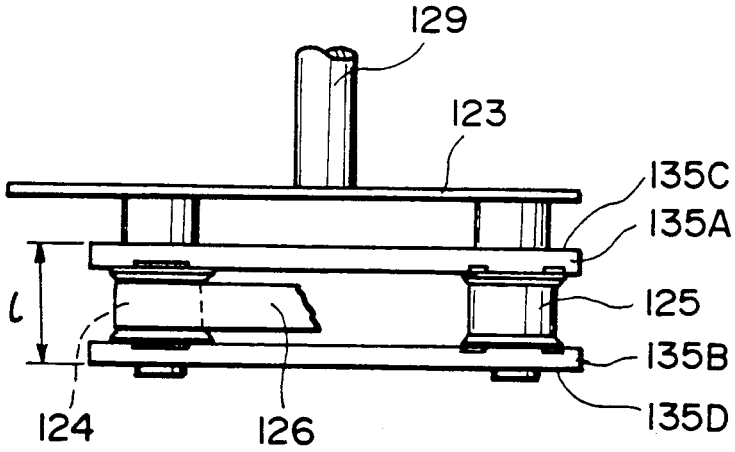
FIG. 11 is a plan view showing the essential portions of the third embodiment.

FIG. 11 shows the details of the pawl member 135. The pawl member 135 comprises a first pawl member 135A and a second pawl member 135B disposed on the opposite sides of movable pulleys 124 and 125.

The distance l between the outer surface 135C of the first pawl member 135A and the outer surface 135D of the second pawl member 135B is smaller than the width of the film, and the film is guided by these two pawl members.

Figure 12:
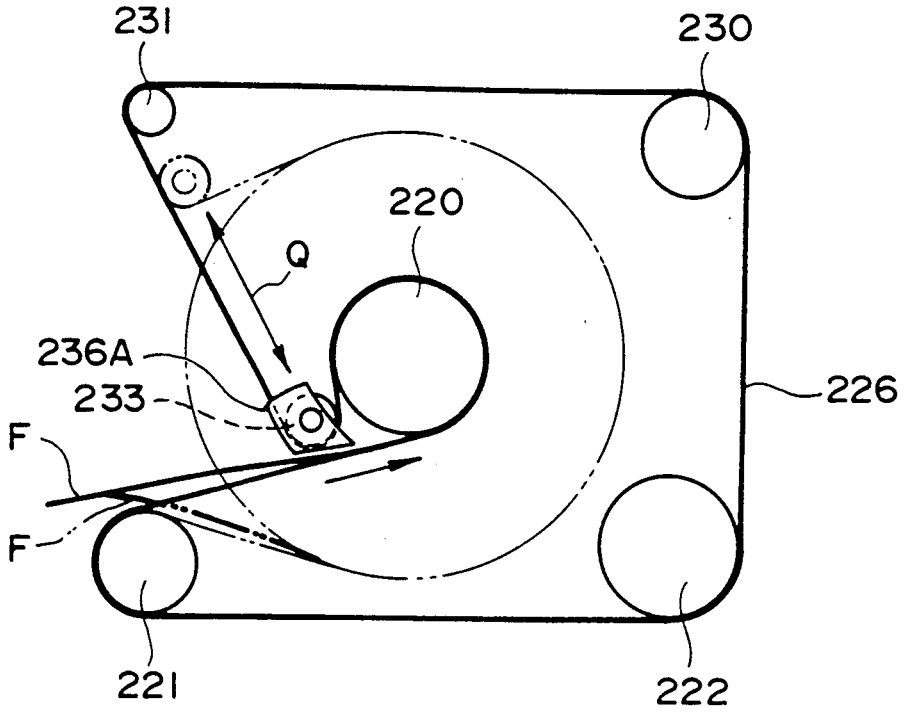
FIG. 12 is an elevational view showing a fourth embodiment of the present invention.
Figure 13:
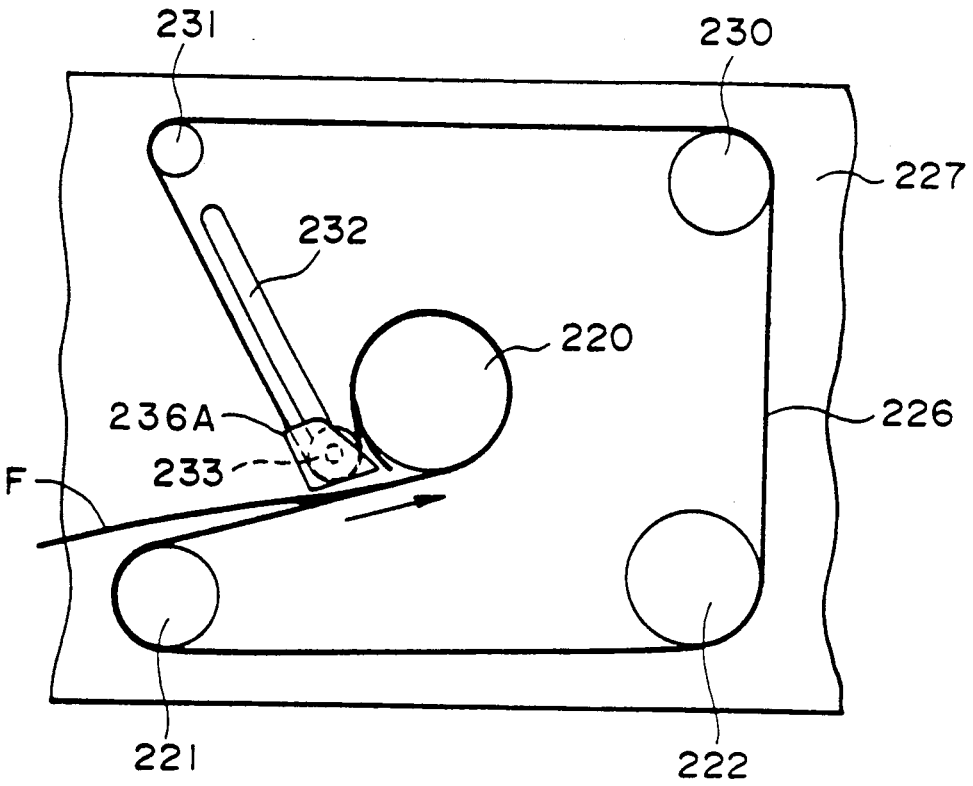
FIGS. 13 and 14 are elevational views illustrating the operation of the fourth embodiment.
Figure 14:
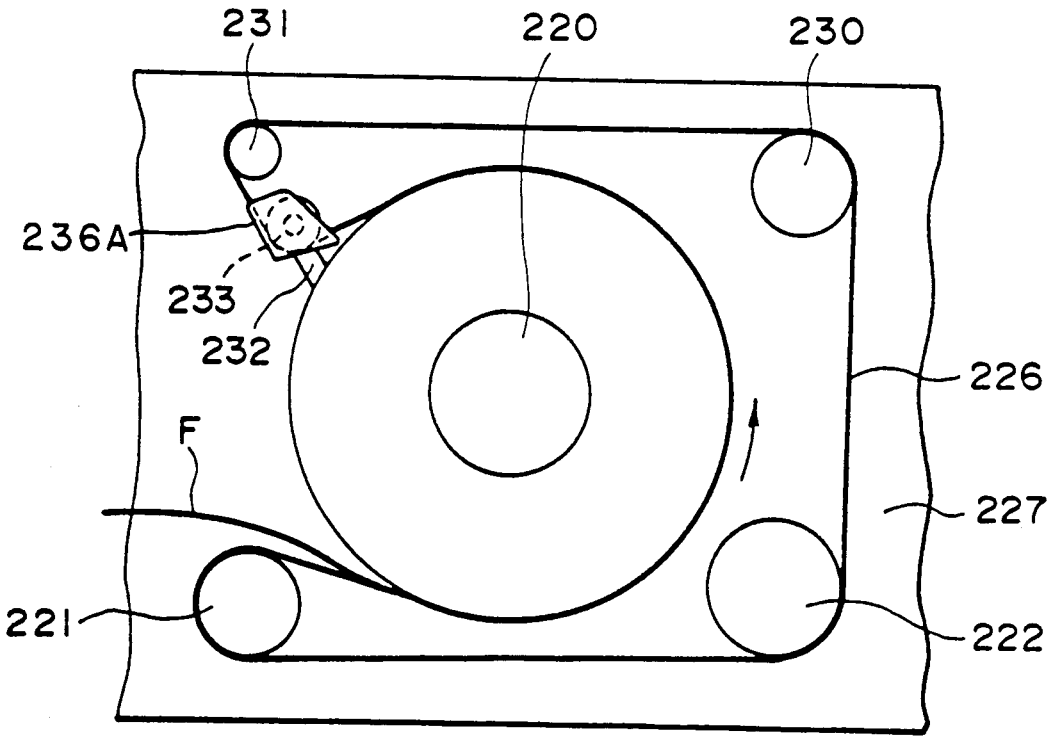

A fifth embodiment which will now be described is such that a pawl member is provided in the third embodiment described with reference to FIGS. 7 to 9. In FIGS. 12, 13 and 14, a pawl member 236A is provided for movement in the direction of arrow Q with a movable pulley 233.

Description will now be made of a sixth embodiment of the present invention in which slack is prevented from occurring in the leading end portion of the taken-up strip-like member.

Figure 15:
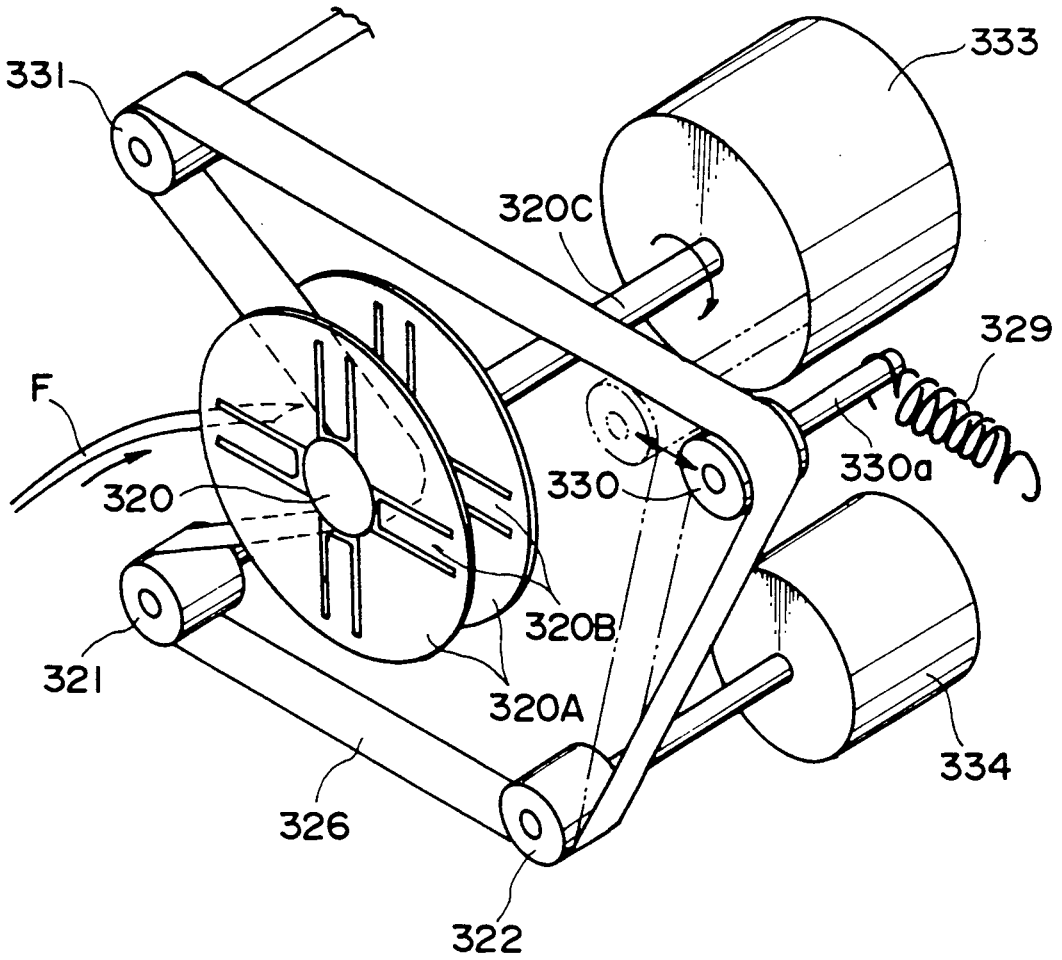
FIG. 15 is a perspective view illustrating a fifth embodiment of the present invention.

Referring to FIG. 15 which is a perspective view showing the device of the present embodiment, a film F which is a strip-like member is fed at a predetermined speed from the supply side (the reel 51, etc. of FIG. 1) to a take-up shaft 320. Driving means (unshown) drives the supply-side reel to feed the strip-like member at a predetermined speed.

The take-up shaft 320 is provided with a pair of flanges 320A and 320A spaced apart from each other by an amount corresponding to the width of the film, and the film is adapted to be held down against the flanges 320A and 320A by slightly inwardly displaced pawls 320B and 320B. The take-up shaft 320 is connected to a motor 333, and the peripheral speed of the take-up shaft 320 during the take-up is higher than the speed of the film fed from the supply side.

Pulleys 321, 322 and 331 rotatably disposed in place on a shaft parallel to and around the take-up shaft 320 and a movable pulley 330 are provided around the take-up shaft 320, and a belt 326 is passed over these pulleys 321, 322, 330, 331 and the take-up shaft 320. The movable pulley 330 imparts tension to the belt 326 by means of a spring 329.

An encoder 334 is connected to one of said pulleys, 322, and detects the speed of the belt 326. That is, the encoder detects the peripheral speed of the take-up shaft when the take-up is started, and detects the peripheral speed of the take-up roll film as the take-up progresses.

Figure 16:
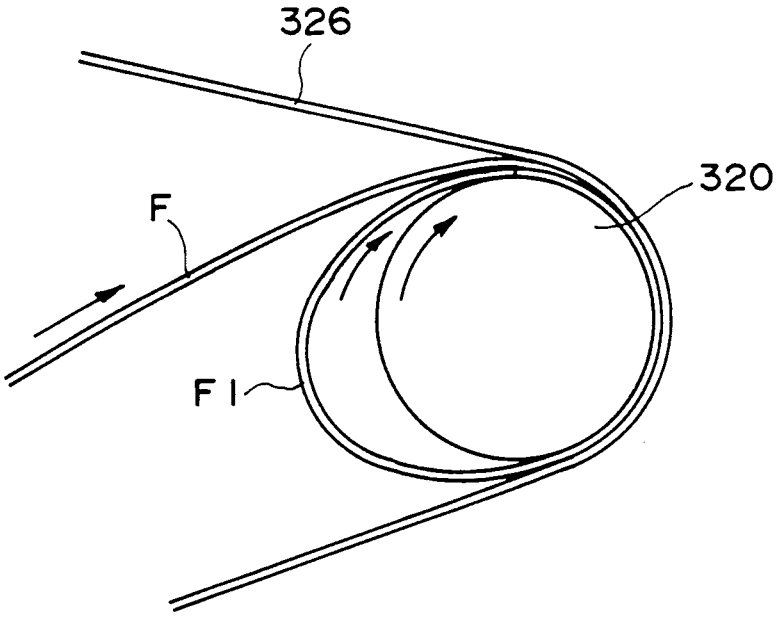
FIGS. 16 and 17 are elevational views showing the operation of the fifth embodiment.
Figure 17:
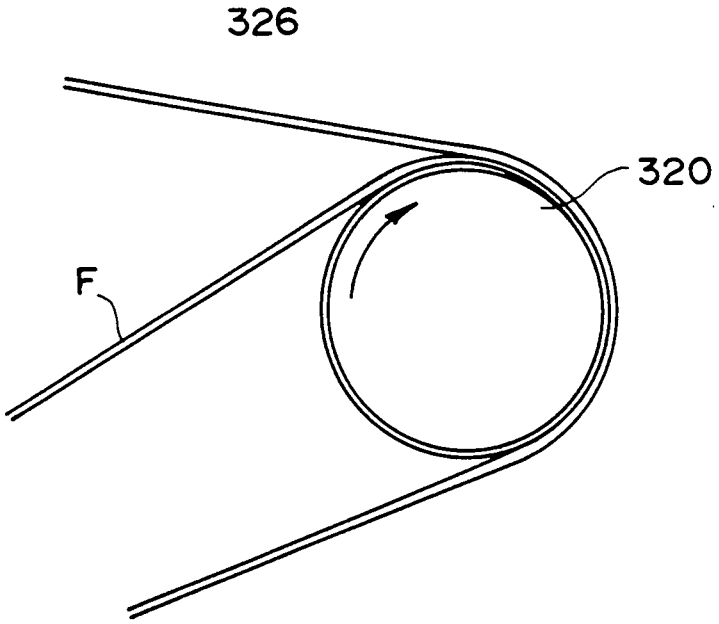

In the present embodiment as described above, even if the leading end portion F1 of the film F slacks as shown in FIG. 16 when the take-up is started, the leading end portion F1 is quickly wound to eliminate said slack (see FIG. 17) because the take-up shaft 320 is rotated at a peripheral speed higher than the speed of the film F.

At this time, the film and the belt are moved at a corresponding speed and therefore, conveyance and control of the film is accurately accomplished without said slack affecting the encoder.

According to the present invention, the belt, namely, the roll film in any take-up state, is driven so as to rotate at a higher speed than the supplied film and thus, not only when the take-up of the film is started, but also after the take-up of the film progresses, the film is tightly wound as is done when slack occurs.

Also in the strip-like member take-up devices shown in FIGS. 2 to 14, if the take-up shaft is rotatively driven by drive means such as a motor so that the peripheral speed of the take-up shaft during the take-up is higher than the speed of the film fed from the supply side, the slack of the leading end portion of the film can be prevented.

We claim:

1. A strip-like member take-up device comprising:

take-up means for taking up the strip-like member being fed thereto, said taken up means including a take-up shaft and a pivot arm;

a belt member for applying an urging force to a surface area of the strip-like member against said take-up shaft;

a first pulley for movably supporting said belt member;

a second pulley for movably supporting said belt member and guiding said belt member so that it is wound around said take-up shaft, and said second pulley being movable in accordance with an amount of the strip-like member taken up by said take-up shaft; and a third pulley for movably supporting a part of said belt member between said first and second pulleys, wherein said second and third pulleys are supported on said pivot arm and movable together so that a first portion of said belt member located between said second pulley and said third pulley is separated from said take up shaft by a first radial distance, a second portion of said belt member located between said first pulley and said third pulley is separated from said take-up shaft by a second radial distance, and said second radial distance increases as the amount of the strip-like member taken up by the take-up shaft increases.

2. A strip-like member take-up device according to claim 1, wherein said take-up shaft is cylindrical.

3. A strip-like member take-up device according to claim 1, further comprising means for biasing said second pulley in a direction to increase the urging force of said belt member.

4. A strip-like member take-up device according to claim 1, wherein said pivot arm includes a pivot center coaxial with a rotational center of said take-up shaft.

5. A strip-like member take-up device according to claim 4, further comprising biasing means for biasing said pivot arm in a predetermined pivoting direction to move said second pulley in a direction to increase the urging force of said belt member.

6. A strip-like member take up device according to claim 4, further comprising bias means for biasing said pivot arm in a predetermined pivoting direction in order to move said second pulley in a direction to increase the surface area of the strip-like member which said belt member urges against said take-up shaft.

7. A strip-like member take up device according to claim 1, wherein the strip-like member is driven at a predetermined speed by supply means, the device further comprising drive means for rotating said take-up shaft such that an initial rotational speed of said take-up shaft is higher than the predetermined speed.

8. A strip-like member take-up device according to claim 1, further comprising bias means for biasing said second pulley in a direction to increase the surface area of the strip-like member which said belt member urges against said take-up shaft.

9. A strip-like member take-up device according to claim 1, further comprising guide means for guiding a leading end of the strip-like member between said belt member and said take-up shaft after the leading end of the strip-like member is initially fed between said belt member and said take-up shaft.

10. A strip-like member take-up device according to claim 1, wherein said belt member comprises an endless belt.

11. A strip-like member take-up device comprising:

take up means for taking up a strip-like member being fed thereto, said take-up means including a take-up shaft for winding the strip-like member, and a pivot arm;

a belt member for applying an urging force to a surface area of the strip-like member against said take-up shaft;

pulley means for supporting said belt member so that the belt member follows said take-up shaft, said pulley means including first, second, and third pulleys, and wherein said second and third pulleys are supported on said pivot arm and movable in accordance with an amount of the strip-like member taken up by said take-up shaft; and guide means disposed on said pivot arm and moving together with said pulley means for guiding a leading end of the strip-like member between said belt member and said take-up shaft after the leading end of the strip-like member is initially fed between said belt member and said take-up shaft.

12. A strip-like member take-up device according to claim 11, wherein said take-up shaft is cylindrical.

13. A strip-like member take-up device according to claim 11, further comprising bias means for biasing said pulley means in a direction to increase the urging force of said belt member.

14. A strip-like member take-up device according to claim 11, wherein said pivot arm includes a pivot center coaxial with a rotational center of said take-up shaft.

15. A strip-like member take-up device according to claim 14, further comprising bias means for biasing said pivot arm in a predetermined pivoting direction in order to move said pulley means in a direction to increase the urging force of said belt member.

16. A strip-like member take-up device according to claim 11, wherein the strip-like member is driven at a predetermined speed by a supply means, the device further comprising drive means for rotating said take-up shaft such that an initial rotational speed of said take-up shaft is higher than the predetermined speed.

17. A strip-like member take-up device according to claim 11, further comprising bias means for biasing said pulley means in a direction to increase the surface area of the strip-like member which said belt member urges against said take-up shaft.

18. A strip-like member take-up device according to claim 11, further comprising bias means for biasing said pivot arm in a predetermined pivoting direction in order to move said pulley means in a direction to increase the surface area of the strip-like member which said belt member urges against said take-up shaft.

19. A strip-like member take-up device according to claim 11, wherein said belt member comprises an endless belt.

20. A strip-like member take-up device comprising:

take-up means for taking up a strip-like member being fed thereto, said take-up means including a take-up shaft and a pivot arm rotating about an axis of said take-up shaft;

a belt member for pressing the strip-like member against said take-up shaft to be wound thereon;

a first pulley for movably supporting said belt member;

a second pulley for movably supporting said belt member and guiding it to be wound around said take-up shaft, said second pulley being movable in accordance with the amount of the strip-like member taken up on said take-up shaft;

a third pulley for movably supporting a part of said belt member between said first and second pulleys at a position out of contact with said take-up shaft, said second and third pulleys being supported on said pivot arm and being movable together, wherein a first portion of said belt member located between said second and third pulleys is positioned a first radial distance from said take-up shaft and moves circumferentially around said take-up shaft in accordance with an increasing amount of the strip-like member wound on said take-up shaft, a second portion of said belt member located between said first and third pulleys is positioned a second radial distance from said take-up shaft, and the second radial distance increases as the amount of the strip-like member wound on said take-up shaft increases.

21. A strip-like member take-up device according to claim 20, wherein said take-up shaft is cylindrical.

22. A strip-like member take-up device according to claim 20, further comprising bias means for biasing said second pulley into a direction where a pressing force by said belt member is increased.

23. A strip-like member take-up device according to claim 20, further comprising bias means for biasing said pivot arm into a predetermined rocking direction to move said second pulley into a direction where a pressing force by said belt member is increased.

24. A strip-like member take-up device according to claim 20, further comprising drive means for rotationally driving said take-up shaft so that an initial peripheral speed of said take-up shaft is larger than that of the strip-like member being fed thereto.

25. A strip-like member take-up device according to claim 20, further comprising bias means for biasing said second pulley into a direction where a pressing range by said belt member is increased.

26. A strip-like member take-up device according to claim 30, further comprising guide means which moves integrally with said second pulley for guiding a tip end of the strip-like member fed into a pressing portion with said belt member after the tip end of the strip-like member initially passes through the pressing portion.

* * * * *

UNITED STATES PATENT AND TRADEMARK OFFICE

CERTIFICATE OF CORRECTION

PATENT NO. :5,058,820

DATED :October 22, 1991

INVENTOR(S) :Masahiko Ito, et al.

It is certified that error appears in the above-identified patent and that said Letters Patent is hereby corrected as shown below:

Title page, item

[56] REFERENCES CITED

FOREIGN PATENT DOCUMENTS, "3491 3/1942 Japan." should read --3491 3/1967 Japan.--.

COLUMN 6:

Line 67, "taken up means" should read --take-up means--.

COLUMN 7:

Line 18, "take up shaft" should read --take-up shaft--.

Line 39, "take up device" should read --take-up device--.

Line 46, "take up device" should read --take-up device--.

Line 67, "take up means" should read --take-up means--.

UNITED STATES PATENT AND TRADEMARK OFFICE

CERTIFICATE OF CORRECTION

PATENT NO. : 5,058,820

DATED : October 22, 1991

INVENTOR(S) : Masahiko Ito, et al

It is certified that error appears in the above-identified patent and that said Letters Patent is hereby corrected as shown below:

COLUMN 10:

Line 16, "claim 30," should read --claim 20,--.

Signed and Sealed this

Thirtieth Day of March, 1993

*Attest:*

STEPHEN G. KUNIN

*Attesting Officer*

*Acting Commissioner of Patents and Trademarks*